US007574155B2

(12) United States Patent
Watanabe

(10) Patent No.: US 7,574,155 B2
(45) Date of Patent: Aug. 11, 2009

(54) DEVELOPING APPARATUS AND IMAGING APPARATUS

(75) Inventor: Yoichiro Watanabe, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 352 days.

(21) Appl. No.: 11/634,176

(22) Filed: Dec. 6, 2006

(65) Prior Publication Data

US 2007/0134015 A1 Jun. 14, 2007

(30) Foreign Application Priority Data

Dec. 13, 2005 (JP) ..... 2005-359225

(51) Int. Cl.
*G03G 15/06* (2006.01)

(52) U.S. Cl. ..... 399/55

(58) Field of Classification Search ..... 399/53, 399/55, 30, 61

See application file for complete search history.

(56) References Cited

U.S. PATENT DOCUMENTS 4,607,954 A * 8/1986 Osaka et al. ..... 399/55
5,805,956 A * 9/1998 Kawai et al. ..... 399/55
5,845,171 A * 12/1998 Ko ..... 399/55
5,970,280 A * 10/1999 Suzuki et al. ..... 399/55
6,134,396 A * 10/2000 Kaneko ..... 399/55
7,062,180 B2 * 6/2006 Suzuki ..... 399/55
7,418,215 B2 * 8/2008 Ide ..... 399/55
2005/0175366 A1 * 8/2005 Hasegawa et al.

FOREIGN PATENT DOCUMENTS

JP 10186877 A * 7/1998
JP 2002108085 A * 4/2002
JP 2003-295567 A 10/2003
JP 2005055468 A * 3/2005
JP 2005234263 A * 9/2005

* cited by examiner

*Primary Examiner*—Susan S Lee
(74) *Attorney, Agent, or Firm*—Shinjyu Global IP

(57) ABSTRACT

The developing apparatus of the present invention is a developing apparatus that develops an electrostatic latent image using a two-component developer containing a toner and a carrier; wherein the developing apparatus has a developing roller that rotates with a developer adhering to the peripheral surface thereof in order to transfer the developer to an electrostatic latent image; a bias unit having a DC voltage applicator that applies a prescribed DC voltage to the developing roller and an AC voltage applicator that applies an AC voltage to the developing roller; a timer that measures the developing apparatus drive time; a measuring unit that measures the amount of developing performed by the developing apparatus; and a bias adjustor whereby the amplitude component of the AC voltage applied by the AC voltage applicator is lowered based on an increase in output of the timer and/or the measuring unit.

10 Claims, 6 Drawing Sheets

DEVELOPING APPARATUS AND IMAGING APPARATUS

CROSS-REFERENCE TO RELATED APPLICATIONS

This application claims priority to Japanese Patent Application No. 2005-359225 filed on Dec. 13, 2005. The entire disclosure of Japanese Patent Application No. 2005-359225 is hereby incorporated herein by reference.

BACKGROUND OF THE INVENTION

1. Field of the Invention

The present invention generally relates to a developing apparatus and an imaging apparatus having the developing apparatus. More specifically, the present invention relates to an apparatus that develops an electrostatic latent image using a two-component developer containing a toner and a carrier.

2. Background Information

In photocopying machines, printers, fax machines, and other imaging devices, for example, an electrostatic latent image is formed by an electrophotographic method in which a uniformly charged photoreceptor drum is selectively exposed. Developing apparatuses in which toner is used to develop the electrostatic latent image are well known. A two-component developer containing a toner and a carrier is often used as the developer in such developing apparatuses. The two-component developer is affixed to a peripheral surface of a developing roller, and transferred to an electrostatic latent image formed on a peripheral surface of the photoreceptor drum, for example.

A prescribed bias voltage is applied to the developing roller in order to control the amount of toner that is transferred. A superimposed voltage having DC and AC voltage is used as the bias voltage.

A bias voltage in which a DC and AC voltage are superimposed as described above is used in an imaging apparatus disclosed in Japanese Laid-open Patent Application No. 2003-295567. A method that progressively increases the amplitude component of the AC voltage is disclosed whereby the amplitude component of the AC voltage is set to 1100 Vpp when the first to the 100,000th image are created, and to 1500 Vpp when the image count is above 100,000. Such a structure, however, lends itself to fogging and other problems. As used herein, "fogging" refers to minute amounts of toner that remain on paper that has been subjected to the imaging operation, even in blank regions where no image has been formed.

In view of the above, it will be apparent to those skilled in the art from this disclosure that there exists a need for an improved a developing apparatus and an imaging apparatus having the developing apparatus. This invention addresses this need in the art as well as other needs, which will become apparent to those skilled in the art from this disclosure.

SUMMARY OF THE INVENTION

The present inventors attempted to use a developing apparatus having the structure described in the above-mentioned document in a two-component developer, and discovered as a result that imaging could not be satisfactorily carried out because fogging as well as other problems occurred.

Such problems were presumed to be due to the fact that the developer is not a magnetic toner (single component developer). Specifically, the technique described in the above-mentioned document is effective with a magnetic toner, but cannot be used with a two-component developer.

With the foregoing in view, it is an object of the present invention to provide a developing apparatus in which a two-component developer can be used, fogging can be prevented, and the apparatus can be used over a long period of time; as well as an imaging apparatus in which the developing apparatus is used.

In order to solve achieve the above object, the developing apparatus of the present invention is a developing apparatus that develops an electrostatic latent image using a two-component developer containing a toner and a carrier. The developing apparatus has a developing roller that rotates with a developer adhering to the peripheral surface thereof in order to transfer the developer to the electrostatic latent image; a bias unit having a DC voltage applicator that applies a prescribed DC voltage to the developing roller and an AC voltage applicator that applies an AC voltage to the developing roller; a timer that measures the developing apparatus drive time; a measuring unit that measures the amount of developing performed by the developing apparatus; and a bias adjustor whereby the amplitude component of the AC voltage applied by the AC voltage applicator is lowered based on an increase in output of the timer and/or the measuring unit. An imaging apparatus that uses the developing apparatus is also within the scope of the present invention.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
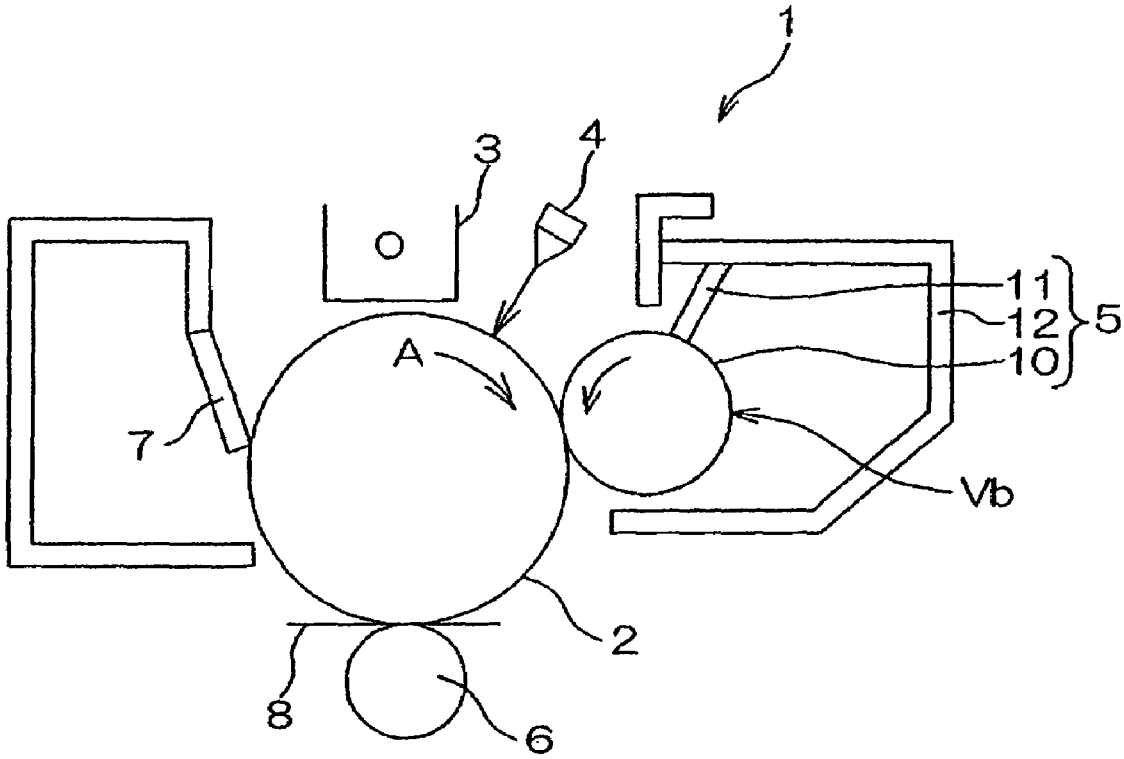
FIG. 1 is a schematic vertical cross-sectional view showing an outline of the structure of a main part of the imaging apparatus in accordance with a preferred embodiment of the present invention.

FIG. 1 is a schematic vertical cross-sectional view showing an outline of the structure of a main part of the imaging apparatus according to a preferred embodiment of the present invention. In reference to FIG. 1, an imaging apparatus 1 is, e.g., a photocopying machine, a printer, or a fax machine, and the apparatus uses an electrophotographic method to form an electrostatic latent image based on image data. The electrostatic latent image is developed using a toner, a toner image is formed, and the toner image is transferred to paper.

The imaging apparatus 1 has a photoreceptor drum 2 used as an electrostatic latent imaging part, a charger 3, an LED head 4, a developing apparatus 5, a transfer roller 6, and a cleaning device 7.

The developer used in the imaging apparatus 1 is preferably a two-component developer containing a toner and a carrier. The carrier is preferably a ferrite carrier in which a silicon resin or the like is coated on the periphery of a magnetic body.

The photoreceptor drum 2 is a cylindrical member that extends in an axial direction (the direction orthogonal to the surface of the paper in FIG. 1). Further, a photoreceptive layer is provided on an outer peripheral surface of the photoreceptor drum 2. The photoreceptor drum 2 is configured to rotate in the direction of the arrow A. The charger 3, the LED head 4, the developing apparatus 5, the transfer roller 6, and the cleaning device 7 are disposed on the periphery of the photoreceptor drum 2 along the rotational direction A.

When an image is formed, the photoreceptive layer is evenly charged by the charger 3 while the photoreceptor drum 2 rotates in the direction of the arrow A. The photoreceptor drum 2 charged by the charger 3 is selectively exposed by the LED head 4 based on image data, and the electrical potential of the exposed photoreceptive layer decreases. An electrostatic latent image based on prescribed image data is accordingly formed on the photoreceptive layer of the photoreceptor drum 2.

Toner is fed from the developing apparatus 5 to the photoreceptor drum 2 on which the electrostatic latent image is formed. An electrostatic latent image is thereby formed on the photoreceptor drum 2, and a toner image is obtained. The toner image is transferred via the transfer roller 6 to paper 8 that has been conveyed to this point. The transferred toner image is fixed to the paper 8 by a fixing device (not shown) at a downstream stage, and the paper is then discharged from the machine.

Meanwhile, toner that has not been transferred to the paper 8 from the photoreceptor drum 2 is scraped from the photoreceptor drum 2 by the cleaning device 7.

Figure 2:
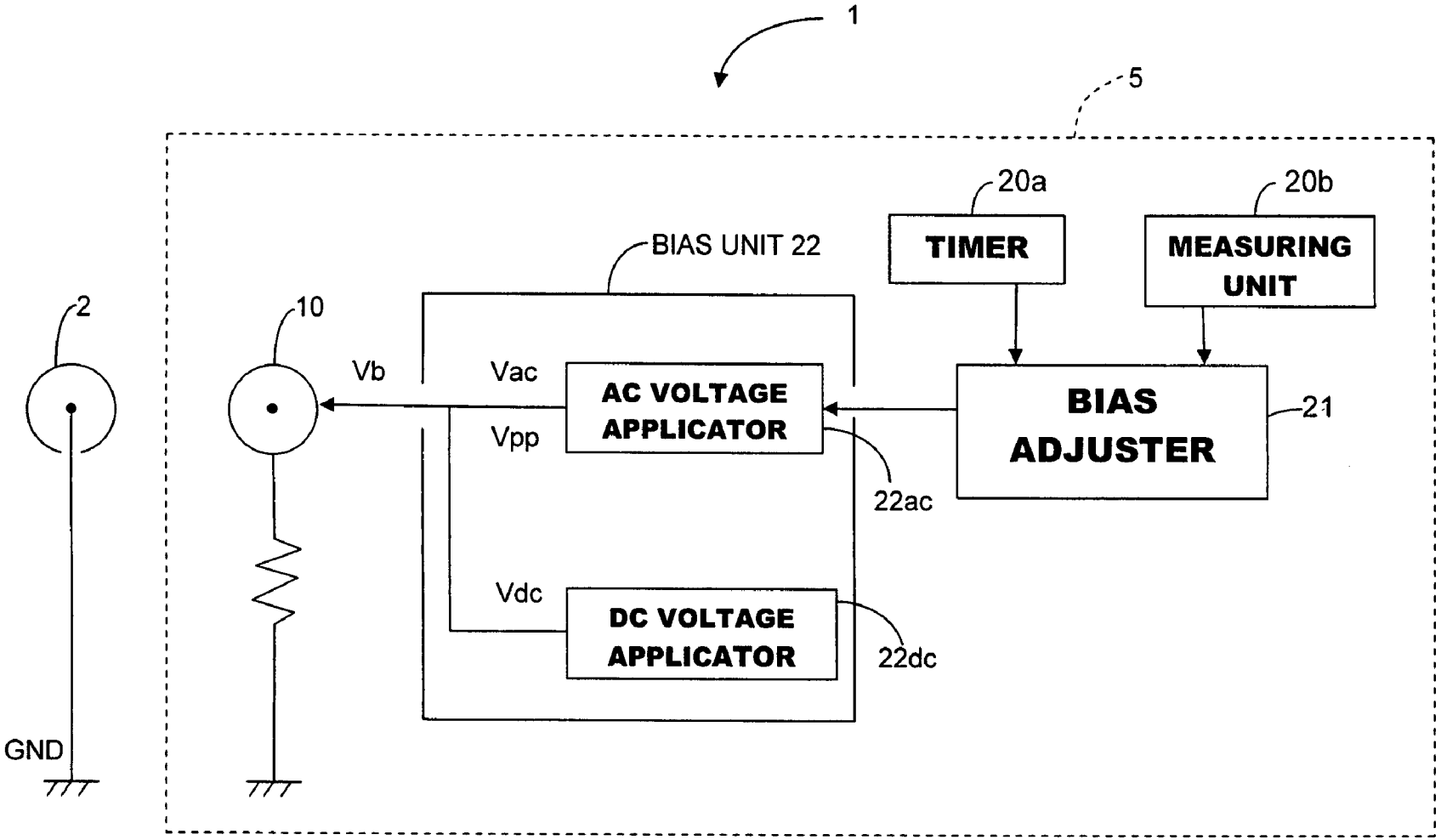
FIG. 2 is a view of a block diagram provided to describe members that adjust and apply a bias voltage Vb.

The developing apparatus 5 has a developing roller 10, a developer layer thickness regulator blade 11, and a housing 12. Referring to FIG. 2, the developing apparatus 5 further includes a bias unit 22 (bias unit) that applies a bias voltage Vb, a bias adjuster 21 (bias adjuster), a timer 20*a* (timer), and a measuring unit 20*b* (measuring unit 20*b*). Descriptions shall next be provided in regard to the bias unit 22, the bias adjuster 21, the timer 20*a*, and the measuring unit 20*b*.

Referring again to FIG. 1, in addition to the developing roller 10, the developer layer thickness regulator blade 11, and other components, the housing 12 accommodates, e.g., a developer and a spiral shaft (not shown) that stirs and conveys the developer.

FIG. 2 is a view of a block diagram describing members that adjusts and applies a bias voltage Vb. The bias unit 22 is provided with an AC voltage applicator 22*ac* and a DC voltage applicator 22*dc*. Both voltages are superimposed and applied to the developing roller 10.

The amplitude component (also referred to below simply as Vpp) of the AC voltage Vac of the bias voltage Vb in the bias unit 22 is adjusted by the bias adjuster 21. The bias adjuster 21 outputs an adjustment signal for the amplitude component Vpp on the basis of the output of the timer 20*a* and the measuring unit 20*b*. The timer 20*a* measures the drive time of the developing apparatus 5, and the measuring unit 20*b* measures the amount of developing performed by the developing apparatus 5.

Referring now to FIGS. 1 and 2, when the imaging process of the imaging apparatus 1 is repeated, the resin coating layer that covers the carrier contained in the two-component developer wears away and deteriorates. The deterioration of the carrier causes the developing performance resulting from the bias voltage Vb applied to the developing roller 10 to be greater than necessary, and fogging occurs on the paper 8.

As described below, the bias adjuster 21 adjusts the Vpp of the bias voltage Vb in order to prevent fogging.

In the imaging apparatus 1 shown in FIGS. 1 and 2, the bias voltage Vb is configured so that the DC voltage Vdc is +200 V, the AC voltage Vac is about 1.5 kV, and the duty ratio is 50%.

An amorphous silicon drum is preferably used as the photoreceptor drum 2, and the drum preferably has a diameter of 80 mm and a film thickness of 20 μm. The photoreceptor drum 2 preferably has a dark potential of 300 V, and a light potential of 20 V. The photoreceptor drum 2 preferably has a linear velocity of 134 mm/sec, and the peripheral velocity ratio of the developing roller 10 and the photoreceptor drum 2 is preferably 1.8.

The distance between the developing roller 10 and the photoreceptor drum 2 is preferably 0.55 mm, and the distance between the developing roller 10 and the developer layer thickness regulator blade 11 is preferably 0.5 mm.

Printing/output of a 4% printing ratio image (A4) was continuously performed in the above conditions using a black monochrome toner. The fog concentration of the sample image printout was measured. The fog concentration is the percentage of blank space on the paper that is blackened by fog.

Figure 3:
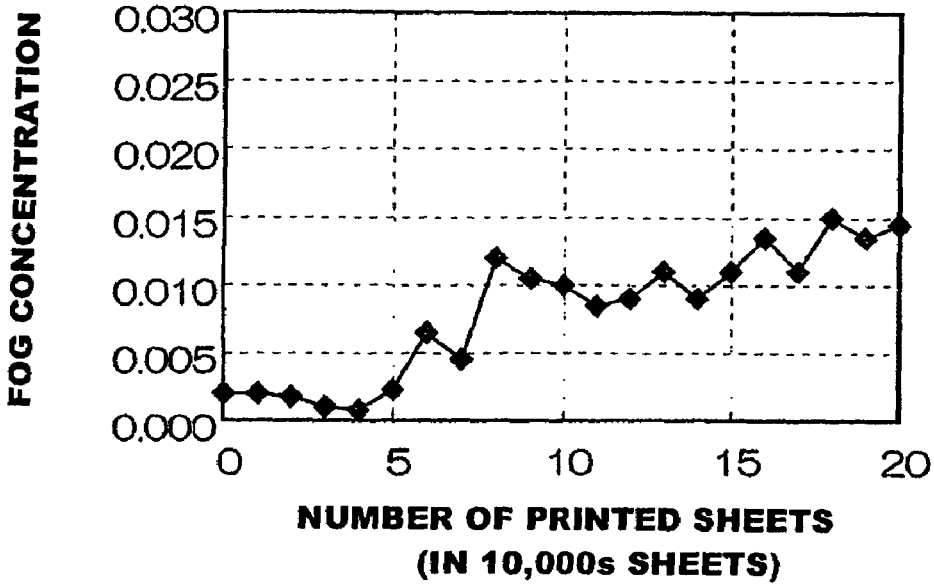
FIG. 3 is a view of a graph showing the fog concentration in a comparative example when the Vpp voltage of the bias voltage is kept constant and independent on the developing apparatus drive time or the number of printed sheets printed out.

FIG. 3 is a view of a graph showing the fog concentration in a comparative example when the Vpp of the bias voltage Vb is kept constant and independent of the drive time of the developing apparatus 5 or the developing amount (in other words, the number of sheets printed out).

The toner had an average grain size of 9 μm and a variation coefficient of 31.1%, and was nonmagnetic.

The carrier had Mn—Mg core particles, a fluorosilicone-coated resin layer, and a weight average grain size of 60 μm.

Under the above conditions, the Vpp was a constant 1.5 kV, and 200,000 sheets were continuously printed out.

As shown in FIG. 3, an acceptable fog concentration of 0.010 or less was achieved for up to 70,000 sheets.

However, when the number of printed sheets reached 80,000, the fog concentration was about 0.012. When the number of printed sheets was 80,000 or greater, the fog concentration frequently exceeded 0.010, and had a tendency to increase as the number of printed sheets increased.

Thus, in the comparative example, when the number of printed sheets was low, an acceptable fog concentration (0.010 or less) was achieved; whereas when the number of printed sheets increased, a satisfactory fog concentration was achieved less frequently, and the fog concentration grew worse as the number of printed sheets increased.

Figure 4:
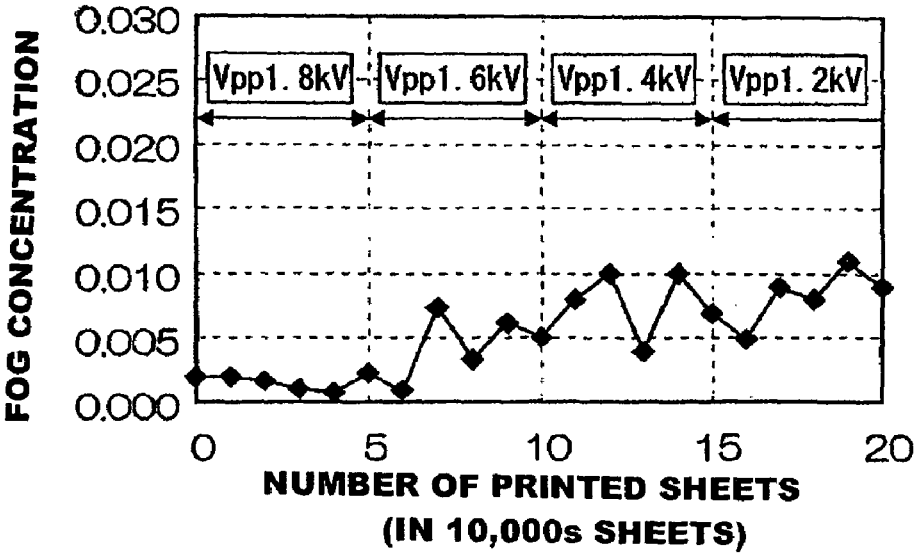
FIG. 4 is a view of a graph showing a fog concentration when the Vpp of the bias voltage Vb is lowered according to the number of printed sheets output by the developing apparatus.

FIG. 4 is a view of a graph showing a fog concentration when the Vpp of the bias voltage Vb was lowered according to the number of sheets output by the developing apparatus 5.

The toner had an average grain size of 9 μm and a variation coefficient of 31.1%, and was nonmagnetic.

The carrier had Mn—Mg core particles, a resin coated layer with a fluorosilicone coating, and a weight average grain size of 60 μm.

Under the above conditions, the Vpp was lowered from 1.8 kV to 1.6 kV, 1.4 kV, and 1.2 kV, or 0.2 kV for every 50,000 sheets printed. 200,000 sheets were printed out.

As shown in FIG. 4, the fog concentration was 0.010 or less, except at the point when 190,000 sheets had been printed, in which case the fog concentration was 0.011. The average value of the fog concentration shown in the drawing was about 0.0055.

Figure 5:
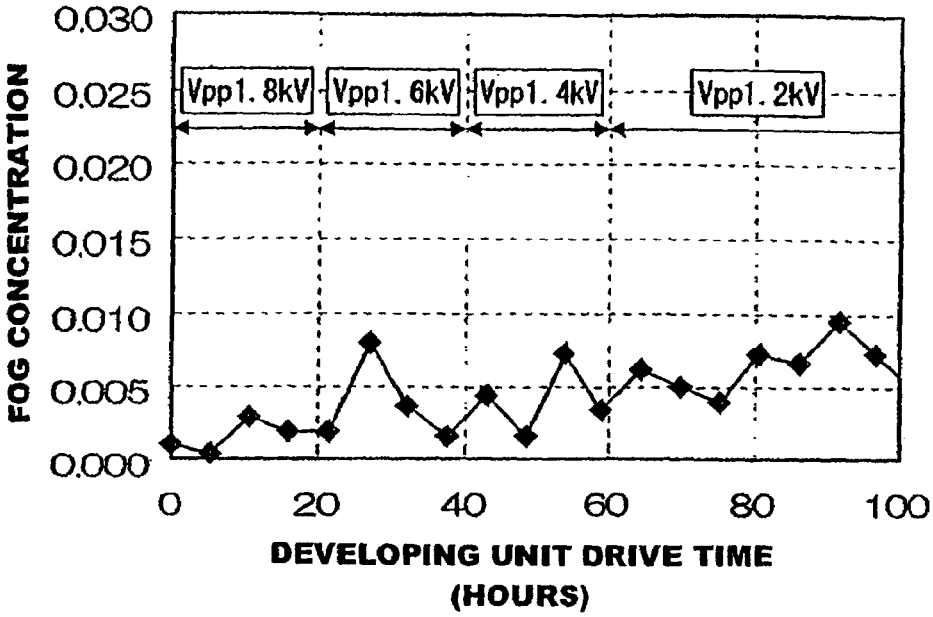
FIG. 5 is a view of a graph showing a fog concentration when the Vpp of the bias voltage Vb is lowered according to the developing apparatus drive time.

FIG. 5 is a view of a graph showing a fog concentration when the Vpp of the bias voltage Vb was lowered according to the drive time of the developing apparatus 5.

The toner had an average grain size of 6.7 μm and a variation coefficient of 24.6%, and was nonmagnetic.

The carrier had Mn—Mg core particles, a fluorosilicone-coated resin layer, and a weight average grain size of 45 μm.

Under the above conditions, the Vpp was lowered from 1.8 kV to 1.6 kV, 1.4 kV, and 1.2 kV, or 0.2 kV, for every 20 hours of drive time. Printing/output was carried out for 100 hours.

As shown in FIG. 5, the graph showing the fog concentration had a tendency to increase slightly in accordance with the drive time of the developing apparatus 5, but none of the fog concentration values exceeded 0.010 when continuous driving was carried out for 100 hours. The average value of the fog concentration shown in the drawing was about 0.0045.

Figure 6:
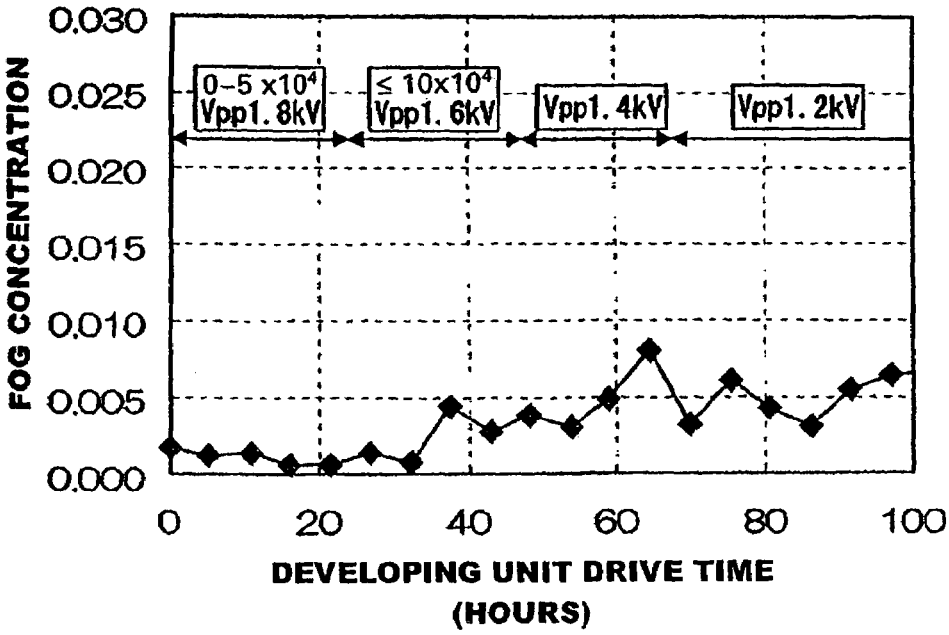
FIG. 6 is a view of a graph showing a fog concentration when the Vpp of the bias voltage Vb is lowered according to the developing apparatus drive time and the number of printed sheets printed out.

FIG. 6 is a view of a graph showing a fog concentration when the Vpp of the bias voltage Vb was lowered according to the drive time of the developing apparatus 5 and the number of output printed sheets.

The toner had an average grain size of 6.7 μm and a variation coefficient of 24.6%, and was nonmagnetic.

The carrier had Mn—Mg core particles, a fluorosilicone-coated resin layer, and a weight average grain size of 45 μm.

Under the above conditions, printing/output was carried out by lowering the Vpp to 1.8 kV and 1.6 kV for every 50,000 printed sheets up to 100,000. The Vpp was then lowered to 1.4 kV and 1.2 kV for every 20 hours of drive time.

As shown in FIG. 6, the graph showing the fog concentration had a tendency to increase slightly in accordance with the drive time of the developing apparatus 5, and the fog concentration was about 0.008 at the highest point (after about 65 hours) when continuous driving was carried out for 100 hours. The average value of the fog concentration was about 0.035.

As described above, FIGS. 4 to 6 show that a satisfactory fog concentration can be achieved by lowering the Vpp according to the drive time of the developing apparatus 5 and/or the number of sheets printed out (amount of development performed).

Figure 7:
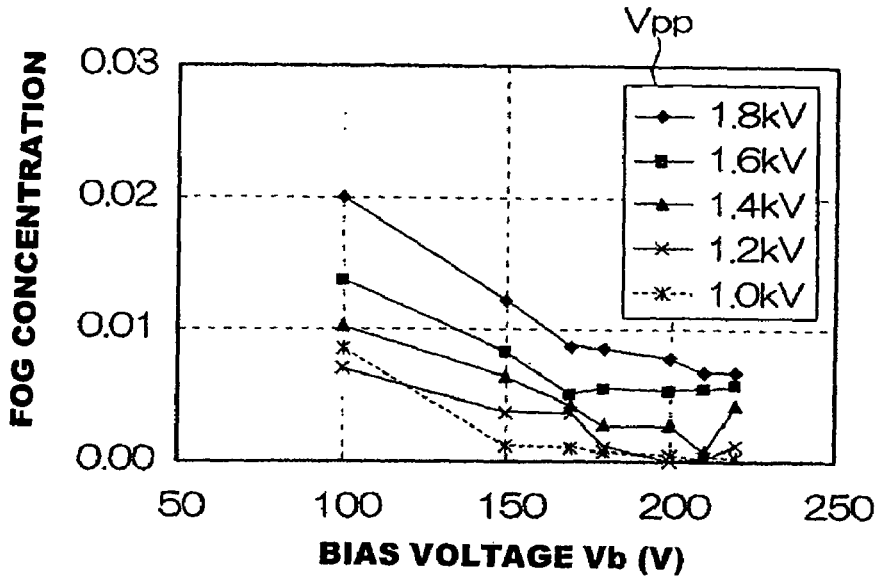
FIG. 7 is a view of a graph showing the relationship between the DC voltage Vdc and the fog concentration for the Vpp values of the bias voltage Vb after 100,000 sheets have been printed out.

FIG. 7 is a view of a graph showing the relationship between the DC voltage Vdc and the fog concentration for the Vpp values of the bias voltage Vb after 100,000 sheets have been printed out.

As explained above, fogging occurs more easily when there is an increase in degraded toner in which the carrier coating has been worn away. FIG. 7 shows that fogging tends to occur when the DC voltage Vdc of the bias voltage Vb is low after 100,000 sheets have been printed out. FIG. 7 also shows that fogging tends to occur when the Vpp of the bias voltage Vb is high. Consequently, outputting blank sheets forcibly expels the degraded toner from the developing apparatus 5 to the outside of the imaging apparatus 1 (i.e., images with a high fog concentration are formed), allowing fogging to be further prevented from occurring.

Figure 8:
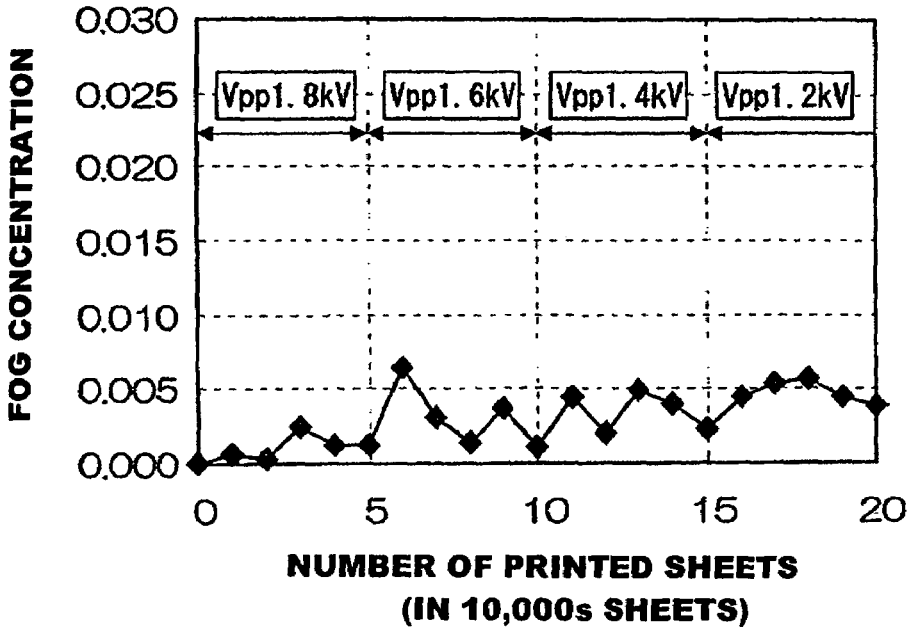
FIG. 8 is a view of a graph showing the fog concentration when blank paper is output and the Vpp has been increased by 0.2 kV only when the blank paper is output at an interval according to the number of printed sheets output by the developing apparatus.
Figure 9:
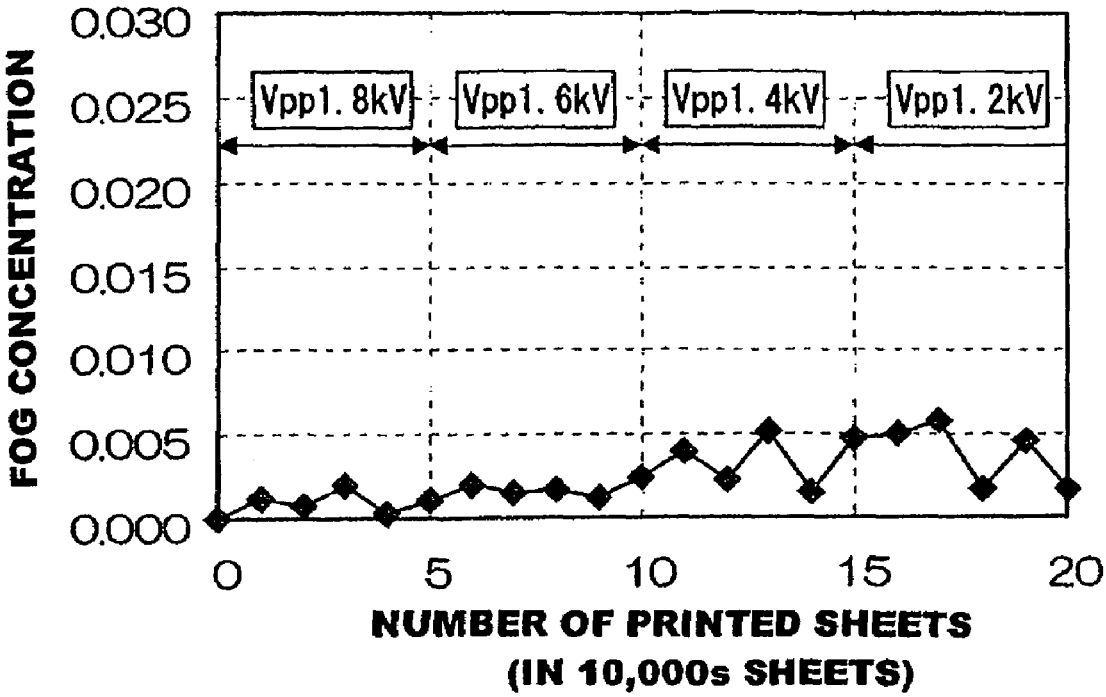
FIG. 9 is a view of a graph showing the fog concentration when blank paper is output and the Vpp is set to 1.8 kV when the blank paper is output according to the number of printed sheets output by the developing apparatus.

In FIGS. 8 and 9 described below, a blank sheet was output at an interval of a prescribed number of printed sheets under the conditions described below in order to further prevent fogging.

FIG. 8 is a view of a graph showing the fog concentration when a blank sheet is output while the Vpp is increased by 0.2 kV relative to a base voltage only for the blank sheet according to the number of sheets output by the developing apparatus 5, after which it is lower 0.2 kV from the base voltage.

The toner had an average grain size of 6.7 μm as well as a variation coefficient of 24.6%, and was nonmagnetic.

The carrier had Mn—Mg core particles, a fluorosilicone-coated resin layer, and a weight average grain size of 45 μm.

Under the above conditions, the Vpp was lowered from 1.8 kV to 1.6 kV, 1.4 kV, and 1.2 kV, or 0.2 kV, for every 50,000 sheets printed. 200,000 sheets were printed out. In addition, a blank sheet was output for every 2000 sheets printed when imaging was not performed, and degraded toner was discharged. The Vpp was increased by 0.2 kV from 1.8 kV, 1.6 kV, or 1.4 kV only when the blank sheets were output, and subsequently lowered to 1.6 kV, 1.4 kV, or 1.2 kV.

As shown in FIG. 8, when the Vpp was increased to a prescribed value and a blank sheet was output after a prescribed number of sheets had been printed out, the highest fog concentration was about 0.007 (when 60,000 sheets had been printed), and the average value of the fog concentration was about 0.003.

FIG. 9 is a view of a graph showing the fog concentration when a blank sheet is output and the Vpp is set to 1.8 kV when the blank sheet is output according to the number of printed sheets output by the developing apparatus 5, after which the Vpp is lower to 1.6 kV, 1.4 kV, and 1.2 kV.

The toner had an average grain size of 9 μm as well as a variation coefficient of 31.1%, and was nonmagnetic.

The carrier had Mn—Mg core particles, a fluorosilicone-coated resin layer, and a weight average grain size of 60 μm.

Under the above conditions, the Vpp was lowered from 1.8 kV to 1.6 kV, 1.4 kV, and 1.2 kV, or 0.2 kV for every 50,000 sheets printed. 200,000 sheets were printed out. In addition, a blank sheet was output for every 2000 sheets printed when imaging was not performed, and degraded toner was discharged. The Vpp was increased to 1.8 kV only when the blank sheets were output.

As shown in FIG. 9, when the Vpp was increased to a prescribed value, a blank sheet was output after a prescribed number of sheets had been printed out, the highest fog concentration was about 0.006 (when 170,000 sheets had been printed), and the average value of the fog concentration was about 0.0025.

As shown above in FIGS. 8 and 9, a better fog concentration can be achieved by outputting blank paper under prescribed conditions and discharging the degraded toner.

The developing apparatus of the present embodiment can be regarded as being a developing apparatus that develops an electrostatic latent image using a two-component developer containing a toner and a carrier, having a developing roller that rotates with a developer adhering to the peripheral surface thereof in order to transfer the developer to the electrostatic image; a bias unit having a DC voltage applicator that applies a prescribed DC voltage to the developing roller and an AC voltage applicator that applies an AC voltage to the developing roller; a timer that measures the developing apparatus drive time; a measuring unit that measures the amount of developing carried out by the developing apparatus; and a bias adjuster whereby the amplitude component of the AC voltage applied by the AC voltage applicator is lowered based on an increase in the output of the timer and/or the measuring unit.

According to this configuration, the amplitude component of the AC voltage applied by the AC voltage applicator in the developing apparatus is lowered by the bias adjustor on the basis of an increase in the output of the timer and/or the measuring unit.

When the imaging process of the imaging apparatus is repeated, the resin coating layer that covers the carrier contained in the two-component developer wears away and deteriorates. The deterioration of the carrier causes the developing performance resulting from the bias voltage applied to the developing roller to be greater than necessary, and fogging occurs on the paper.

As used herein, "fogging" refers to minute amounts of toner that remain on paper that has been subjected to the imaging operation, even in blank regions where no image has been formed.

In order to prevent fogging, the bias adjustor lowers the amplitude component of the AC voltage applied by the AC voltage applicator in conjunction with the deterioration of the carrier. The bias unit is accordingly able to apply a suitable bias voltage to the developing roller, resulting in improved developing performance of the developing apparatus.

An example can be envisioned whereby the bias adjustor lowers the amplitude component of the AC voltage according to the increase of the drive time. The bias adjustor adjusts the AC voltage applicator so as to lower the amplitude component of the AC voltage, based on an increase in the output of the timer that measures the drive time. Specifically, printing/output is carried out by lowering the amplitude component of the AC voltage in a stepwise manner (e.g., from 1.8 kV to 1.6 kV, 1.4 kV, and 1.2 kV) each time a prescribed drive time (e.g., 20 hours) has elapsed.

In another scenario that can be envisioned, the bias adjuster lowers the amplitude component of the AC voltage according to the amount of developing. The bias adjustor adjusts the AC voltage applicator to lower the amplitude component of the AC voltage, based on an increase in the output of the measuring unit that measures the developing amount. Specifically, printing/output is carried out by lowering the amplitude component of the AC voltage in a stepwise manner (e.g., lowered from 1.8 kV to 1.6 kV, 1.4 kV, and 1.2 kV) each time a prescribed number of sheets is printed out (e.g., 50,000 sheets).

The developing apparatus can accordingly apply a suitable bias voltage to the developing roller according to the state of the two-component developer. As a result, fogging can be prevented, and the developing apparatus can be used for extended periods of time.

The imaging apparatus of the present embodiment can also be regarded as having an electrostatic latent imaging unit that forms an electrostatic latent image by an electrophotographic method, and a developing apparatus that uses toner to develop the resulting electrostatic latent image. The imaging apparatus has the developing apparatus that uses a two-component developer as described above; therefore, fogging can be prevented and the imaging apparatus can be used for extended periods of time. In the present embodiment, the electrostatic latent imaging unit or imaging apparatus 1 has a photoreceptor drum 2, a charger 3, and an LED head 4.

The developing apparatus of the present embodiment can be described as follows.

(a) A developing apparatus comprising: a developing roller being configured to rotate with a photoreceptor drum to provide toner to a peripheral surface of said photoreceptor drum having a electrostatic latent image; a bias unit having a DC voltage applicator being configured to apply a prescribed DC voltage to said developing roller and an AC voltage applicator being configured to apply an AC voltage to said developing roller; a measuring unit being configured to measure a developing amount performed by said developing apparatus; and a bias adjustor being configured to lower an amplitude component of the AC voltage applied by said AC voltage applicator based on said developing amount.

(b) The developing apparatus according to (a), further comprising a timer being configured to measure a drive time of said developing apparatus, and said bias adjustor is configured to lower said amplitude component when said drive time reaches a predetermined level.

(c) A developing apparatus comprising: a developing roller being configured to rotate with a photoreceptor drum to provide toner to a peripheral surface of said photoreceptor drum having a electrostatic latent image; a bias unit having a DC voltage applicator being configured to apply a prescribed DC voltage to said developing roller and an AC voltage applicator being configured to apply an AC voltage to said developing roller; a timer being configured to measure a drive time of said developing apparatus; and a bias adjustor being configured to lower an amplitude component of the AC voltage applied by said AC voltage applicator when said drive time reaches a predetermined level.

(d) An imaging apparatus comprising: an electrostatic latent imaging unit being configured to form an electrostatic latent image by an electrophotographic method; and a developing apparatus having a developing roller being configured to rotate with a photoreceptor drum to provide toner to a peripheral surface of said photoreceptor drum having a electrostatic latent image, a bias unit having a DC voltage applicator being configured to apply a prescribed DC voltage to said developing roller and an AC voltage applicator being configured to apply an AC voltage to said developing roller, a timer being configured to measure a drive time of said developing apparatus and a bias adjustor being configured to lower an amplitude component of the AC voltage applied by said AC voltage applicator when said drive time reaches a predetermined level.

"Means plus function" clauses as utilized in the specification and claims should include any structure or hardware and/or algorithm or software that can be utilized to carry out the function of the "means plus function" clause.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including," "having," and their derivatives. Also, the terms "part," "section," "portion," "member," or "element" when used in the singular can have the dual meaning of a single part or a plurality of parts. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A developing apparatus comprising:

a developing roller being configured to rotate with a photoreceptor drum to provide toner to a peripheral surface of the photoreceptor drum having a electrostatic latent image;

a bias unit having a DC voltage applicator being configured to apply a prescribed DC voltage to the developing roller and an AC voltage applicator being configured to apply an AC voltage to the developing roller;

a measuring unit being configured to measure a developing amount performed by the developing apparatus after the developing amount reaches a predetermined level;

a bias adjustor being configured to lower an amplitude component of the AC voltage applied by the AC voltage applicator based on the developing amount; and a timer being configured to measure a drive time of the developing apparatus, and the bias adjustor is configured to lower the amplitude component based on the drive time.

2. The developing apparatus according to claim 1, wherein the amplitude component is 0.2 kV.

3. The developing apparatus according to claim 2, wherein the developing amount is 10,000 sheets.

4. The developing apparatus according to claim 1, wherein the predetermined level is 50,000 sheets, and the drive time is 20 hours.

5. The developing apparatus according to claim 1, wherein the bias adjustor is configured to raise the amplitude component above a current amount for the output of a blank sheet before lowering the amplitude component a predetermined amount below the current amount based on the developing amount.

6. The developing apparatus according to claim 5, wherein the amount the amplitude component is raised above the current amount is predetermined based on the current amount.

7. The developing apparatus according to claim 6, wherein the amount the amplitude component is raised above the current amount is 0.2 kV.

8. The developing apparatus according to claim 5, wherein the amount the amplitude component is raised above the current amount varies to reach a set voltage.

9. The developing apparatus according to claim 8, wherein the set voltage is 1.8 kV.

10. An imaging apparatus comprising:

an electrostatic latent imaging unit being configured to form an electrostatic latent image by an electrophotographic method; and a developing apparatus having a developing roller being configured to rotate with a photoreceptor drum to provide toner to a peripheral surface of the photoreceptor drum having a electrostatic latent image, a bias unit having a DC voltage applicator being configured to apply a prescribed DC voltage to the developing roller and an AC voltage applicator being configured to apply an AC voltage to the developing roller, a measuring unit being configured to measure a developing amount performed by the developing apparatus after the developing amount reaches a predetermined level, a bias adjustor being configured to lower an amplitude component of the AC voltage applied by the AC voltage applicator based on developing amount, and a timer being configured to measure a drive time of the developing apparatus, and the bias adjustor is configured to lower the amplitude component based on the drive time.

* * * * *